US006020298A

United States Patent [19]

Silvani et al.

[11] Patent Number: 6,020,298

[45] Date of Patent: Feb. 1, 2000

[54] SOLVENT CLEANING AGENTS INCLUDING ADDITIVES OF THE FORMULA $R_F$-CFX-L CONTAINING PERFLUOROALKYLENIC UNITS

[75] Inventors: Rossella Silvani, Lentate sul Seveso; Gianfranco Spataro, Lissone; Giuseppe Marchionni, Milan, all of Italy

[73] Assignee: Ausimont S.p.A., Milan, Italy

[21] Appl. No.: 09/071,807

[22] Filed: May 4, 1998

Related U.S. Application Data

[62] Division of application No. 08/810,771, Mar. 5, 1997, Pat. No. 5,780,414.

[51] Int. Cl.[7] ..... C11D 3/24; C11D 3/20; C11D 3/43

[52] U.S. Cl. ..... 510/365; 510/506; 510/475; 510/204; 510/256; 510/271; 510/273; 134/42

[58] Field of Search ..... 510/365, 506, 510/475, 204, 236, 271, 273; 134/42

[56] References Cited

U.S. PATENT DOCUMENTS

| | | | |
|---|---|---|---|
| 2,242,218 | 5/1941 | Auer | 91/70 |
| 3,665,041 | 5/1972 | Sianesi et al. | 260/615 A |
| 3,715,378 | 2/1973 | Sianesi et al. | 260/463 |
| 3,810,874 | 5/1974 | Mitsch et al. | 260/75 H |
| 4,348,310 | 9/1982 | Silva et al. | 524/167 |
| 4,587,165 | 5/1986 | Ohmori et al. | 428/334 |
| 4,845,268 | 7/1989 | Ohsaka et al. | 560/184 |
| 5,382,614 | 1/1995 | Scarati et al. | 524/108 |
| 5,443,747 | 8/1995 | Inada et al. | 252/94 |
| 5,654,263 | 8/1997 | Abusleme et al. | 510/365 |

FOREIGN PATENT DOCUMENTS

| | | |
|---|---|---|
| 0148482 | 7/1985 | European Pat. Off. . |
| 0239123 | 9/1987 | European Pat. Off. . |
| 695755 | 2/1996 | European Pat. Off. . |
| 695775 | 2/1996 | European Pat. Off. . |
| 0 712 944 | 5/1996 | European Pat. Off. . |
| 95/31965 | 11/1995 | WIPO . |
| WO 95/32174 | 11/1995 | WIPO . |

OTHER PUBLICATIONS

Wolf, G.C., "Cleaning Electronic Assemblies" Research Disclosure, No. 323, Mar. 1, 1991, p. 208, XP000176301. Database WPI, Section Ch, Week 9650, Derwent Publications, Ltd., London, GB; Class D25, AN 96–503018, XP002029482, & JP 08 259995 A (Agency of Ind Sci & Tech) Oct. 8, 1996 *abstract*.

*Primary Examiner*—Yogendra Gupta
*Assistant Examiner*—Charles Boyer
*Attorney, Agent, or Firm*—Nikaido, Marmelstein, Murray & Oram, LLP

[57] ABSTRACT

Use of solvents capable of removing oily substances without solubilizing them, consisting of hydrofluoropolyethers having the general formula $$HF_2CO(CF_2O)_n(CF_2CF_2O)_mCF_2H$$

wherein n and m are integers comprised between 0 and 20, excluding when m and n are contemporaneously 0, and having boiling point from 30° to 200° C. and having a molar ratio 0/C comprised between 0.5–1.

2 Claims, No Drawings

SOLVENT CLEANING AGENTS INCLUDING ADDITIVES OF THE FORMULA $R_F$-CFX-L CONTAINING PERFLUOROALKYLENIC UNITS

This application is a division of Ser. No. 08/810,771 filed Mar. 5, 1997 now U.S. pat. No. 5,780,414.

The present invention relates to solvents utilizable as cleaning rinsing agents and capable of removing oils, greases, waxes, etc. from surfaces, which show no toxicity and have no impact on the ozone and low impact on the global warming.

More particularly the present invention relates to solvents having the above charateristics which are capable of removing oily substances, greases, waxes, etc. without solubilizing them.

The technical problem to be solved by the present invention regards the need to have available solvents which are not toxic and have the characteristics indicated above. Such problem is particularly felt since the laws of the various countries have banned or are going to ban the use of most solvents, utilized so far, due to impact problems on the ozone.

As examples of solvents which cannot be used any longer due to their impact on the ozone we can mention solvents containing chlorine, chlorofluorocarbons (CFC) and in the future also hydrochlorofluorocarbons (HCFC).

More specifically the technical problem to be solved regards solvents having the above properties and further be capable of removing oily substances without solubilizing them so that the separation processes for the recovery of the solvents only require common mechanical apparatus, such as skimming or filtering, wihout having to resort to more complex and expensive separation processes, such as for instance fractional or azeotropic distillation.

Another characteristic the solvents must have is that they must not be flammable in order not to incur safety, storage and transport problems.

It was felt the need to have available solvents combining the indicated characteristics and at the same time giving performances comparable with those of the clorinated solvents or chlorofluorocarbons currently utilized in washing operations, i.e. the removal of the oily substance being at least 97.0% by weight.

Solvents capable of removing oily substances, without solubilizing them, and this is an object of the present invention, have been unexpectedly and surprisingly found, having general formula $$HF_2CO(CF_2O)_n(CF_2CF_2O)_mCF_2H$$

wherein n and m are integers comprised between 0 and 20, excluding when m and n are contemporaneously 0, and having boiling point from 30° to 200° C. and preferably from 60° to 150° C., and having a molar ratio O/C between 0.5–1.

The above hydrofluoropolyethers are generally constituted by a mixture of components having a different molecular weight with boiling points comprised in the ranges previously indicated.

Hydrofluoropolyethers of the present invention are obtained by means of decarboxylation processes of alkaline salts obtained by hydrolysis and salification of the corresponding acylfluorides, by means of processes known in the art. For instance decarboxylation is carried out in the presence of hydrogen-donor compounds, for instance water, at temperatures of 140–170° C. and under pressure of at least 4 atm. See for instance patent EP 695775 and the examples reported therein.

Oily substances or greases and waxes based on oily substances which can be removed without solubilization are silicone, fluorosilicone oils or hydrogenated based oils.

Silicone oils are well known and are generally polymethylsiloxanes with different viscosity, for instance from 50 to 30,000 cSt.

Among fluorosilicones, trifluoropropylmethylpolysiloxane, etc. can be mentioned.

By oils having an hydrogenated basis are meant products based on mineral oils derived from petroleum or on synthetic or semi-synthetic oils. Mineral resins, polyalphaolefins, mineral oils such as for instance the dimer ester, can be mentioned.

The results of the present invention are more unexpected if we consider that tests carried out by the Applicant have shown that perfluoropolyethers having perfluoroalkylic terminals —$CF_3$, —$C_2F_5$, —$C_3F_7$, and also fluoropolyethers containing only one end hydrogen are not capable of removing oily substances without solubilizing them with results of industrial interest.

It has been found and this is a further object of the invention, in particular that for oils having an hydrogenated basis or derivatives therefrom it is suitable to add to the solvents of the present invention an additive, as defined below, to increase the removal capacity of oily substances.

Additives are polar and liquid substances at the use temperature which must be soluble in the solvent of the invention for at least 1% by weight.

Obviously higher concentrations can be utilized, provided they are within the solubility limits. Usual concentrations are generally comprised between 5–10% by weight.

Among polar substances we can mention alcohols, for instance from 1 to 4 carbon atoms, preferably isopropylic alcohol; ketones among which acetone, methylethylketone, etc. can be mentioned; ethers among which diethylic ether can be mentioned.

The preferred additives are those containing polar groups in compounds comprising carbon and fluorine, for instance in perfluoroalkane or hydrofluoroalkane chains; the number of carbon atoms is generally such as to render the product liquid as indicated above for the solubility.

The preferred compounds are those from 2 to 6 carbon atoms, for instance $CF_3CH_2OH$, $(CF_3)_2CHOH$.

Other preferred compounds are polar substances comprising fluorooxyalkylenic units selected from ($C_3F_6O$), ($C_2F_4O$), (CFXO) wherein X is equal to F or $CF_3$, ($CR_1R_2CF_2CF_2O$) wherein $R_1$ equal to or different from $R_2$ is H, F, perfluoroalkyl $C_1$–$C_3$.

Compounds can in particular be mentioned having the general formula:

$$R_f\text{-CFX-L}$$

$$L\text{-}CF_2\text{-}R_f\text{-}CF_2\text{-}L$$

wherein $R_f$ is selected from perfluoroalkanes, hydrofluoroalkanes, a) —$(C_3F_6O)_{m'}(CFXO)_{n'}$— wherein the unit $(C_3F_6O)$ and (CFXO) are pefluorooxyalkylenic units statistically distributed along the chain; m' and n' are integers such as to give products with boiling point generally from 25° and 300° C., preferably higher than that of the solvent of the invention $HF_2CO(CF_2O)_n(CF_2CF_2O)_mCF_2H$ and m'/n' is comprised between 5 and 40, when n' is different from 0; X is equal to F or $CF_3$; n' can be also 0;

b) $$—(C_2F_4O)_{p'}(\underset{\underset{X}{|}}{CFO})_{q'}—(C_3F_6O)_{t'}$$

wherein p', q' and t' are integers such as to give products with the boiling point indicated above in a), p'/q' ranges from 5 to 0.3, preferably 2.7–0.5; t' can be 0 and q'/q'+p'+t' lower than or equal to 1/10 and the t'/p' ratio is from 0.2 to 6;

c) —$(CR_1R_2CF_2CF_2O)_n$— wherein $R_1$ and $R_2$ have the meaning indicated above and n is an integer such as to give products with the boiling point indicated above in a);

$R_f$ when is monofunctional has an end group of —$OR_3$ type wherein $R_3$ is a perfluoroalkyl $C_1$–$C_3$;

wherein L is a group containing polar groups, in particular selected from:

—$CH_2OH$; —$CH_2OCH_2CH_2OH$; —$CH_2(OCH_2CH_2)_{n'''}OR'$ wherein n''' is an integer between 2 and 15 and R' is H, $CH_3$, $COCH_3$; —$CONHCH_2CH_2OH$.

The preferred additive has formula $R_f$-CFX-L in which $R_f$ has the structure of a).

The fluoropolyethers indicated are obtainable by the processes well known in the art for instance U.S. Pat. Nos. 3,665,041, 2,242,218, 3,715,378, and the European patent EP 239,123. The functionalized fluoropolyethers are obtained for instance according to patents EP 148,482, U.S. Pat. No. 3,810,874.

The perfluoroalkanes have in general from 4 to 20 carbon atoms, preferably from 8 to 12; the hydrofluoroalkanes have the same structure of the perfluoroalkanes but have one or more hydrogen at terminal end.

The solvents of the invention allow a removal of oily substances even higher than 97%. The solvent remaining on the substratum is easily removable by evaporation.

The substrata which can be treated with the solvents of the invention are generally both of organic and inorganic type. Metals, ceramic or glass materials, polymeric substrata can be mentioned.

The removal of oily products can be carried out according to known techniques: by immersion or by spray. In case of immersion, the contact between solvent of the invention and the surface to be cleaned can be favoured by utilizing a ultrasonic bath, which allows to remove more effectively also the solid polluting agents.

The following examples are given for illustrative purposes and are not limitative of the scope of the invention.

EXAMPLE 1

De-oiling: removal of oily products

As solvent (HFPE) a product of formula $$HF_2CO(CF_2O)_n(CF_2CF_2O)_mCF_2H$$

was employed, having a boiling range comprised between 100° and 120° C., number average molecular weight Mn=380 and O/C ratio equal to 0.66.

The product consists of a HFPE mixture having different molecular weight.

The capacity of removing oily products was tested according to the following method.

One drop of the oily product is deposited on the bottom of a glass crystallization vessel and HFPE is slowly added letting it flow along the walls of the vessel.

The behaviour of the oily drop is then observed:

if the drop completely comes off from the bottom, the test is to considered positive;

if the drop remains anchored to the bottom, or it only partially comes off, the test is negative.

The de-oiling tests were carried out with the following oils.

| | |
|---|---|
| MeSilicone oil | 50 cSt Dow Corning |
| MeSilicone oil | 500 cSt Dow Corning |
| FluoroSilicone oil | FS1265 ® Dow Corning |
| Silicone oil | DC 200 ® Dow Corning |
| Dearomatized resin | D40 ® Exxon |
| PAO (polyalphaolefin) | 40 cSt Itec ® |
| Diester | PRIOLUBE ® 3967 Unichem International |

The de-oiling tests were carried out by utilizing HFPE both pure and in admixture with a non ionic additive containing fluorine having the formula $$CF_3O(C_3F_6O)_{m'}(CFXO)_{n'}CF_2CH_2(OCH_2CH_2)_{n'''}OH$$

wherein X=F, $CF_3$, n'''=5–6, m'+n'=4 having number average molecular weight Mn of 1100.

The additive was utilized when only a partial removal of the drop from the HFPE occurred.

The additive concentration employed in Example 1 was equal to 1% by weight.

The non ionic fluorine-containing additive was preferred to polar solvents such as alcohols, ketones to avoid flammability problems. The HFPE/additive mixtures have no Flash Point.

The results of the De-oiling tests are reported in Table 1.

EXAMPLE 2

(comparative)

For comparison purposes de-oiling tests as described above (Example 1) were carried out by utilizing:

PFPE (GALDEN Y) having formula:

$$CF_3—(OCF(CF_3)CF_2)_n(OCF_2)_m—OCF_3$$

having n/m=40 and boiling point=90° C. and number average molecular weight Mn of 460.

PFC having formula $C_6F_{14}$ and boiling point of 59° C.

1,1,2-trichlorotrifluoroethane (CFC-113)

The results are reported in Table 1.

EXAMPLE 3

The HFPE of Example 1 was employed to test the capacity of removing silicone oils from ceramic substrata (chip) according to the following method.

A known amount of silicone oil is put uniformly on electronic components.

The electronic components are weighed on analytical balance and then put into contact with the HFPE in question.

After 5 minutes of immersion, the components are dried for 1 hour at room temperature so as to completely remove the solvent and then weighed again.

The result of the test is expressed as percentage of removed oil.

The conditions of the tests are the following:

| | |
|---|---|
| room temperature | 20° C. |
| oil amount | 0.1 g |
| HFPE amount | 30 ml |

The employed oils are the following:

| | |
|---|---|
| MetilSilicone | 500 |
| FluoroSilicone | FS1265 ® Dow Corning |
| Silicone | DC200 ® Dow Corning |

The results are reported in Table 2.

EXAMPLE 4

(comparative)

The same removal tests of Example 3 were repeated with the following fluids:

PFPE GALDEN Y of Example 2

1,1,2-trichlorotrifluoroethane (CFC-113)

PFC of Example 2

The results are given in Table 2.

As it can be noted by comparing the results of Example 3 with those of Example 4, the HFPE of the present invention allow to remove silicone oils with an effectiveness comparabale with that of CFC-113.

The HFPE show moreover the great advantage to remove the oil without dissolving it, wherefore HFPE can be recovered by simple filtering. With the usually utilized solvents, oil passes in solution and therefore the only recycle mean of the solvent remains distillation.

TABLE 1

| OIL | HFPE | HFPE + additive | GALDEN Y (*) | PFC (*) | CFC-113 (*) |
|---|---|---|---|---|---|
| MeSilicone 50 | + | + | + | − | # |
| MeSilicone 500 | + | + | − | − | # |

TABLE 1-continued

| OIL | HFPE | HFPE + additive | GALDEN Y (*) | PFC (*) | CFC-113 (*) |
|---|---|---|---|---|---|
| FS1265 | + | + | − | − | # |
| DC200 | + | + | − | − | # |
| EXXON D40 | − | + | − | # | # |
| PAO | − | + | − | − | # |
| Ester dimer | − | + | − | − | # |

* comparative
+ removal without solubilization
− poor or null removal
# removal with solubilization

TABLE 2

| OIL | HFPE | GALDEN Y (*) | PFC (*) | CFC-113 (*) |
|---|---|---|---|---|
| MeSilicone 500 | 98.7% (+) | 62.0% (+) | 82.0% (+) | 100% (#) |
| FS1265 | 99.3% (+) | 74.0% (+) | 23.0% (+) | 99.6% (#) |
| DC200 | 97.2% (+) | 49.0% (+) | 23.0% (+) | 98.9% (#) |

(*) comparative
(+) removal without solubilization
(#) removal with solubilization

We claim:

1. A composition comprising one or more additives of formula:

$$R_f—CFX—L$$

in which $R_f$ is $—(C_3F_6O)_{m'}(CFXO)_{n'}$-wherein the unit $(C_3F_6O)$ and (CFXO) are perfluorooxyalkylenic units statistically distributed along the chain; $_{m'}$ and $_{n'}$ are integers such as to give products with boiling points from about 25° to 300° C., and the ratio $_{m'/n'}$ is from 5 to 40, X is equal to F or $CF_3$; L is a moiety containing polar groups selected from the group consisting of $—CH_2OH$; $CH_2OCH_2CH_2OH$; $CH_2(OCH_2CH_2)_{n''}$"OR' wherein $_{n''}$" is an integer between 2 and 15 and R' is H, $CH_3$ and $COCH_3$; and $CONHCH_2CH_2OH$.

2. A composition according to claim 1 further comprising a compound of formula:

$$HF_2CO(CF_2O)_n(CF_2CF_2O)_mCF_2H$$

wherein n and m are integers from 0 to 20, excluding when m and n are contemporaneously 0, and having a boiling point from 30° to 200° C. and a molar ratio O/C ranging from 0.5 to 1.

* * * * *